United States Patent [19]

Hart

[11] Patent Number: 4,707,934

[45] Date of Patent: Nov. 24, 1987

[54] JUMPING SHOE ATTACHMENT

[76] Inventor: LeRoy Hart, 9340 NE. 76th St., Vancouver, Wash. 98662

[21] Appl. No.: 909,721

[22] Filed: Sep. 22, 1986

[51] Int. Cl.[4] ..... A43B 3/10; A43B 25/10

[52] U.S. Cl. ..... 36/7.8; 36/132; 272/114

[58] Field of Search ..... 36/7.8, 102, 132, 136, 36/27, 28; 272/65, 96, 101, 114

[56] References Cited

U.S. PATENT DOCUMENTS

| | | | |
|---|---|---|---|
| 1,587,749 | 6/1926 | Bierly | 36/7.8 |
| 2,475,092 | 7/1949 | Harrell | 36/7.8 |
| 2,756,517 | 7/1956 | Youtz | 36/7.8 |
| 3,205,596 | 9/1965 | Hoffmeister | 36/7.8 |
| 3,251,145 | 5/1966 | Mack | 36/7.8 |
| 3,377,722 | 4/1968 | Downing | 36/7.8 |
| 3,444,631 | 5/1969 | MacLeod | 36/7.8 |
| 3,522,953 | 8/1970 | Gold et al. | 280/21 |
| 3,979,842 | 9/1976 | Texidor | 36/115 |
| 4,196,903 | 4/1980 | Illustrato | 36/114 |
| 4,302,891 | 12/1981 | Gulli | 36/7.8 |
| 4,449,256 | 5/1984 | Prueitt | 36/7.8 |
| 4,449,256 | 5/1984 | Prueitt | 36/4 |
| 4,492,374 | 1/1985 | Lekhtman | 272/114 |

FOREIGN PATENT DOCUMENTS

| | | | |
|---|---|---|---|
| 650754 | 10/1962 | Canada | 272/114 |
| 3034126 | 3/1982 | Fed. Rep. of Germany | 36/114 |
| 3048787 | 7/1982 | Fed. Rep. of Germany | 36/132 |
| 3334141A | 4/1985 | Fed. Rep. of Germany . | |

*Primary Examiner*—Henry S. Jaudon
*Assistant Examiner*—Steven N. Meyers
*Attorney, Agent, or Firm*—Kolisch, Hartwell & Dickinson

[57] ABSTRACT

This jumping shoe is worn as a pair for simulating trampoline motion. Primarily, it consists of a frame with a canvas stretched at the top with a shoe secured to it for a wearer, and aircraft-type rubber cords are provided and attached to the canvas for providing an upward motion of the wearer and the structure.

12 Claims, 4 Drawing Figures

FIG. 1
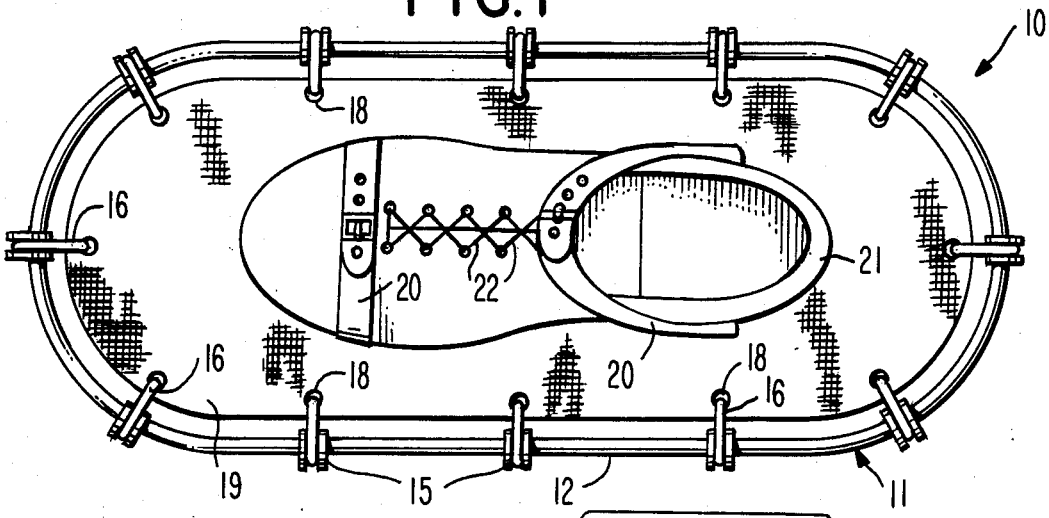
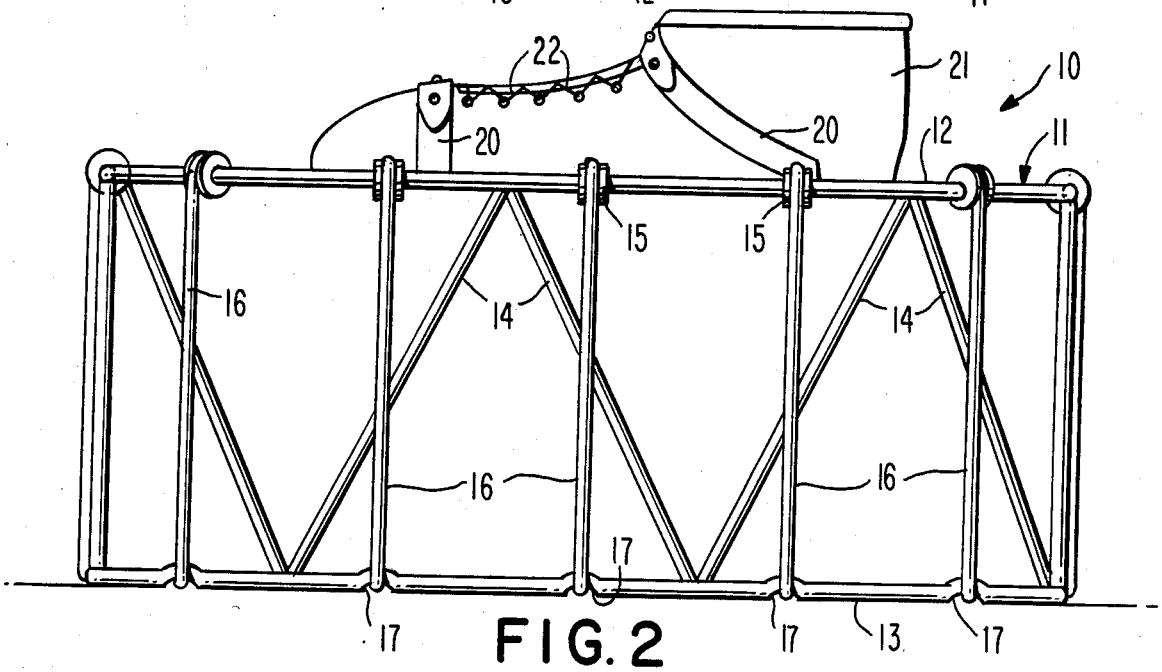
FIG. 2
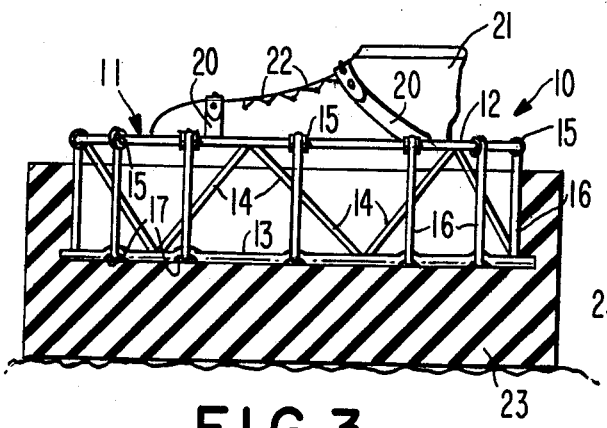
FIG. 3
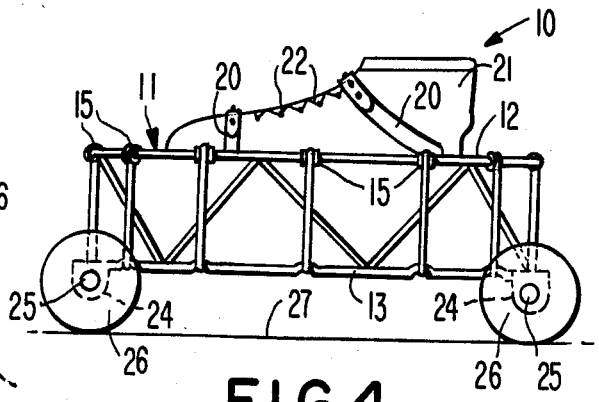
FIG. 4

JUMPING SHOE ATTACHMENT

BACKGROUND OF THE INVENTION

1. Field of the Invention

This invention relates to shoe attachments, and more particularly, to a jumping shoe.

2. Description of Prior Art

Various types of footwear have been devised in the art. The jumping shoe in accordance with the present invention, is designed to be worn by children and adults for amusement, and is a novel alternate to using a small trampoline for exercise.

The principle object of this invention is to provide a jumping shoe, which will be so designed, as to provide amusement and exercise for children and adults alike.

Another object of this invention is to provide a jumping shoe, which will be fabricated for different weights, so as to be employed by people of various sizes.

BRIEF DESCRIPTION OF THE DRAWINGS

FIG. 1 is a top plan view of the present invention;

FIG. 2 is a side view of FIG. 1, shown in elevation;

FIG. 3 is a side view of a modified form of the invention, and

FIG. 4 is similar to FIG. 3, but illustrates another modified form of the invention.

SUMMARY OF THE INVENTION

A jumping shoe structure, comprising a frame in which is stretched in the top, a canvas with a canvas shoe secured thereto, and aircraft-type shock cords are secured to the canvas and frame to provide spring like action to the wearer's feet.

DETAILED DESCRIPTION

Accordingly, a shoe structure 10 is shown to include an aluminum or plastic frame 11 composed of an oval shaped top member 12 spaced from a similar shaped bottom member 13. A plurality of cross-braces are fixedly secured to the top and bottom members 12 and 13, and a plurality of pulleys 15i, sometimes referred to herein as "low friction means", are equal spaced mounted to top member 12 and engage with rubber shock cords, or resilient means 16 which are fastened in grooves 17 formed in the bottom member 13. The other ends of cords 16 are similarly fastened in grommets 18 that are fixedly secured in the near edges of a canvas 19. A pair of adjustable straps 20 are also fixedly secured to the top of canvas 19 and provide hold-down means for a canvas shoe 21 that includes laces 22.

In use, the wearer puts his or her foot in the shoe 21 and straps it securely by the straps 20, and it is to be noted, that structure 10 is worn in pairs, one to each foot. When the wearer jumps up and down, the frames 11 when striking the floor or ground, will cause the weight of the wearer to cause the canvas 19 to go downward, and a forceful elevation is effected to the wearer by the shock cords bringing the canvas 19 forcefully upward.

Referring now to FIG. 3, structure 10 is recessed and secured in a medium hard rubber block, or encasing means 23 for protecting floors and decreasing noise.

In use, structure 10 functions in the same manner described, with the exception, that the rubber block 23 is attached thereto.

Referring now to FIG. 4, structure 10 is modified to include bottom brackers 24 fixedly secured to the bottom member 13, and axle 25 means are provided in brackets 24 and receive wheels 26 for rolling engagement with the ground 27.

In use, the embodiment of FIG. 4 functions the same, with the exception, that rolling engagement is also effected for those who can achieve a higher skill.

While various changes may be made in the detail construction, such changes will be within the spirit and scope of the present invention, as defined by the appended claims.

What I now claim is:

1. A jumping shoe, comprising, a frame, said frame having a bottom member which engages a ground surface, a top member having a plurality of pulleys mounted thereon and cross braces connecting said top member and said bottom member, a plurality of shock cords attached at one end to said bottom member and arranged to extend upwardly so as to pass over said pulleys and be attaced at another end to a canvas sheet, so as to attain said sheet in position, and a shoe attached to said sheet for a foot of a wearer.

2. A jumping shoe as set forth in claim 1, wherein said sheet is streteched on the interior of said top member and said shoe is fixedly secured to a top surface of said sheet by a pair of adjustable straps, and when said wearer of said jumping shoe jumps up and down, the weight of said wearer causes said sheet to descend and said shock cords to be stretched, and whereby said shock cords act to return said sheet to said position.

3. A jumping shoe attachment, for use with a shoe, having trampoline-like characteristics, comprising:

a frame having a bottom, ground engaging member, an open, planar, peripherally-extending top member, and brace means spacing said top member from said bottom member;

resilient means extending laterally inwardly from said top member to an area where the shoe is to be mounted to provide lateral resiliency thereto; and hold down means for securing the shoe to said resilient means.

4. The attachment of claim 3 wherein said resilient means includes plural elongate resilient members.

5. The attachment of claim 3 with further includes encasing means for encasing a lower portion of said frame.

6. The attachment of claim 3 which further includes wheels rotatably afixed to said frame and located to permit rolling of said frame on a surface.

7. A jumping shoe attachment, for use with a shoe, having trampoline-like characteristics, comprising:

a frame having a bottom, ground engaging member, an open, planar, peripherally-extending top member, and brace means spacing said top member from said bottom member;

resilient means extending laterally inwardly from said top member to an area where the shoe is to be mounted, to provide lateral resiliency thereto; and hold down means for securing the shoe to said resilient means; and low-friction means disposed about said top member and wherein said resilient members extend from said bottom member and across said low-friction means.

8. The attachment of claim 7 wherein said low-friction means includes plural pulleys disposed about the periphery of said top member.

9. In combination with a shoe, a jumping shoe attachment having trampoline-like characteristics, comprising:

a frame having a bottom, grounding engaging member, and open, planar top member having a edge thereabout, and brace means spacing said top member from said bottom member;

a web mounted in the plane of said top member;

resilient, web-mounting means for mounting said web for resilient, vertical movement relative to said top member, said mounting means including plural elastic cords, each secured to the periphery of said web and to said frame, for biasing said web in the plane of said top member; and hold down means for seucring the shoe to said web.

10. The attachment of claim 9 wherein said mounting means further includes plural pulleys disposed about the edge of said top member and rotatably mounted thereon, and wherein each of said elastic cords is trained over a pulley.

11. The attachment of claim 9 which further includes encasing means for encasing a lower portion of said frame.

12. The attachment of claim 9 which further includes wheels rotatably affixed to said frame.

* * * * *